United States Patent [19]

Donzis

[11] Patent Number: 4,513,449

[45] Date of Patent: Apr. 30, 1985

[54] SHOCK ABSORBING ATHLETIC EQUIPMENT

[76] Inventor: Byron A. Donzis, 23 Lana La., Houston, Tex. 77027

[21] Appl. No.: 495,753

[22] Filed: May 18, 1983

Related U.S. Application Data

[63] Continuation-in-part of Ser. No. 478,681, Mar. 25, 1983, , which is a continuation-in-part of Ser. No. 357,588, Mar. 12, 1982, abandoned.

[51] Int. Cl.[3] ..... A41D 13/00

[52] U.S. Cl. ..... 2/2; 2/22

[58] Field of Search ..... 2/2, 22; 5/434

[56] References Cited

U.S. PATENT DOCUMENTS

| | | | |
|---|---|---|---|
| 3,044,075 | 7/1962 | Rawlings | 2/22 |
| 3,465,364 | 9/1969 | Edelson | 2/22 |
| 3,507,727 | 4/1970 | Marshack | 5/434 X |

*Primary Examiner*—Louis K. Rimrodt
*Attorney, Agent, or Firm*—Arnold, White & Durkee

[57] ABSTRACT

A structure is provided which absorbs shock by the controlled transfer of air from within an enclosure to outside the enclosure. A core of open-celled foam material is provided to act as an exhaustable reservoir of air within the enclosure. This structure is adapted to provide comfort and freedom of movement to the wearer. Cooperatively arranged with this structure are one or more inserts positioned to provide exceptional protection to one or more selected areas of the wearer's body. These inserts are designed to not loose shock absorbing capability when subjected to forces of anticipated magnitudes. Thus, protective equipment is provided which yields general protection to at least a portion of the wearer's body while providing exceptional protection at selected areas of such individual's body.

28 Claims, 16 Drawing Figures

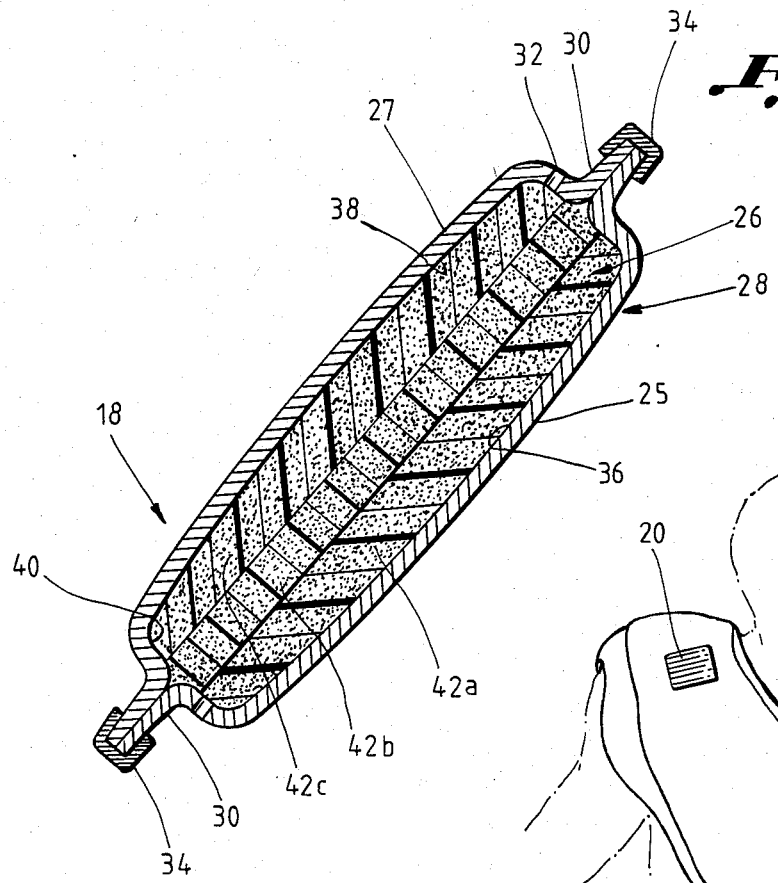
Fig. 4
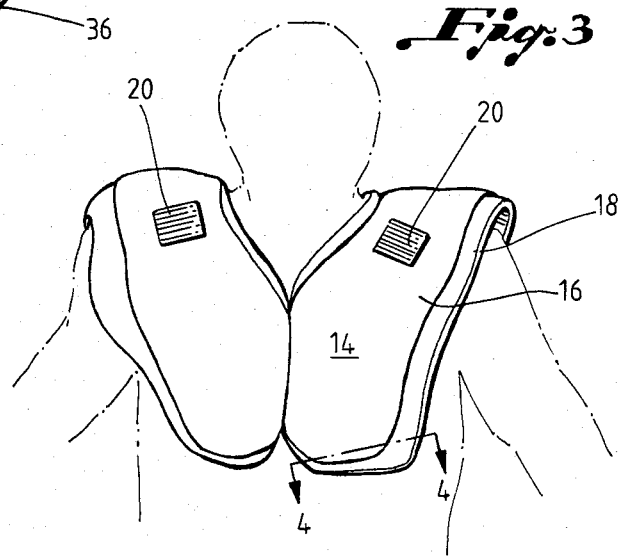
Fig. 3
Fig. 7
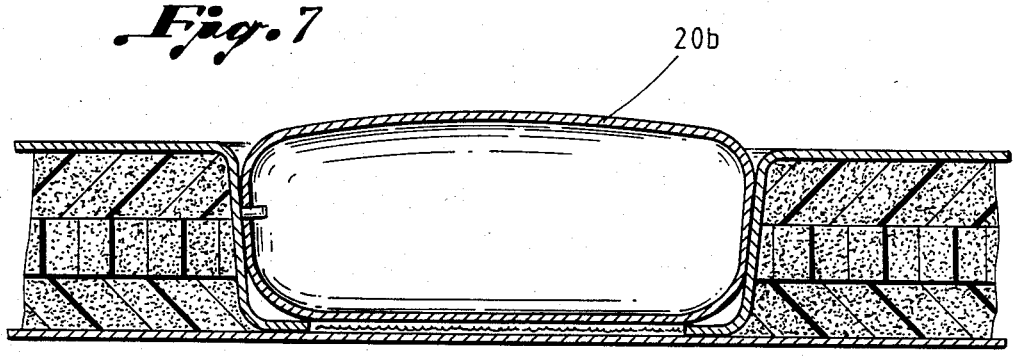

SHOCK ABSORBING ATHLETIC EQUIPMENT

CROSS REFERENCE TO RELATED APPLICATIONS

This patent application is a continuation-in-part of my earlier filed application, Ser. No. 478,681, filed on Mar. 25, 1983, for MULTI-LAYERED, OPEN CELLED FOAM SHOCK ABSORBING STRUCTURE FOR ATHLETIC EQUIPMENT, which in turn is a continuation-in-part of application Ser. No. 357,588, filed on Mar. 12, 1982, for PROTECTIVE SHOCK ABSORBING EQUIPMENT, now abandoned.

BACKGROUND OF THE INVENTION

This invention relates generally to shock absorbing equipment and more specifically relates to shock absorbing athletic wear for providing increased protection to selected body areas of the wearer.

Athletic equipment, such as, for example, shoulder pads, rib protectors, hip pads, and thigh pads, are commonly worn by participants in many types of sports to protect the wearer from shock resulting from contact with an object or with another participant. Such equipment has long been known and used by athletes in contact sports such as football, hockey, etc., but is also of benefit to participants in other sports such as baseball, moto-cross, equestrian events, and so forth.

One type of known prior art athletic equipment includes a relatively hard outer shell of a material such as plastic, leather, vulcanized fiber, or the like, and an inner layer of soft padding material. The hard outer layer is adapted to receive the applied force or shock and to spread the force over a large area where the force is absorbed and cushioned by the soft padding material, thereby protecting the wearer from the shock of impact. Padding materials commonly known with these prior art designs include cotton padding, foam rubber, foamed plastic material, sponge rubber, expanded rubber, or vinyl, for example. Such designs rely upon the resilience of the padding material to absorb a portion of the applied force.

In my prior filed U.S. patent application Ser. No. 478,681, filed Mar. 25, 1982, I disclosed a protective apparatus wherein an open-celled foam element is covered with a fabric. This fabric covering is generally impermeable to air, but has a plurality of air permeable regions selectively distributed therein. The air permeable regions provide continuous fluid communication between the foam portion inside the fabric covering and the atmosphere outside. In a particularly preferred embodiment of the invention, a shield structure is provided to distribute an impacting force across an area of the fabric covered foam. Upon application of a force to the fabric covered foam, a portion of the volume of air contained with the cell structure of the foam is selectively transferred through the air permeable regions of the fabric covering to the outside of the covering. The controlled air transfer of this invention has great applicability in reducing the shock transmitted to the wearer of such equipment. However, in many applications it may be preferable to provide exceptional protection to specific injury prone areas of the body. This exceptional protection must be provided without unduly restricting the wearer's freedom and speed of movement and without significantly affecting his comfort.

Accordingly, the present invention provides a method and apparatus whereby general shock absorbing protection may be provided to an individual's body and whereby exceptional shock absorbing protection may be provided at selected points of such individual's body while facilitating optimal comfort and freedom of movement to the individual.

SUMMARY OF THE INVENTION

Shock absorbing athletic equipment in accordance with the present invention includes a shock absorbing element which is designed to cover the portion of the wearer's body which is to be protected such that a force impacting that portion of the wearer's body will first encounter the shock absorbing structure. The shock absorbing structure will have a body portion which includes a multi-layer laminate of open-celled foam which is encased within an airtight fabric enclosure. This foam is placed in limited fluid communication with the exterior of the enclosure by mechanisms such as valves or apertures through the enclosure. At selected areas, corresponding to areas of the wearer's body for which protection is particularly desired, shock absorbing inserts are situated proximate the wearer's body. The shock absorbing inserts are preferably attached, either permanently or removably, to the body portion. These shock absorbing inserts are designed such that they will not "bottom out" and lose their shock absorbing capability when they are subjected to a force of a magnitude which the wearer of the athletic equipment is expected to encounter. In a particularly preferred embodiment, these inserts are formed of a multi-layered open-celled foam laminate encased within a flexible enclosure, as described for the body portion, except that air transfer between the interior and exterior of the enclosure will be further limited relative to the body portion such that the insert provides a greater degree of impact protection than does the body portion. Again in a particularly preferred embodiment, a semi-rigid shield element will be disposed between an impacting force and the shock absorbing structure discussed above, so as to distribute such impacting force over a larger area of the shock absorbing structure.

BRIEF DESCRIPTION OF THE DRAWINGS

FIG. 3 illustrates a portion of the athletic equipment of FIG. 1.

FIG. 4 is a cross-sectional view of the shock absorbing element of the athletic equipment of FIG. 3, taken along line 4—4 in FIG. 3.

FIG. 7 illustrates a cross-sectional view of another alternative embodiment of a shock absorbing element in accordance with the present invention, also as might be seen along line 5—5 in FIG. 3.

DETAILED DESCRIPTION OF A PREFERRED EMBODIMENT

Figure 1:
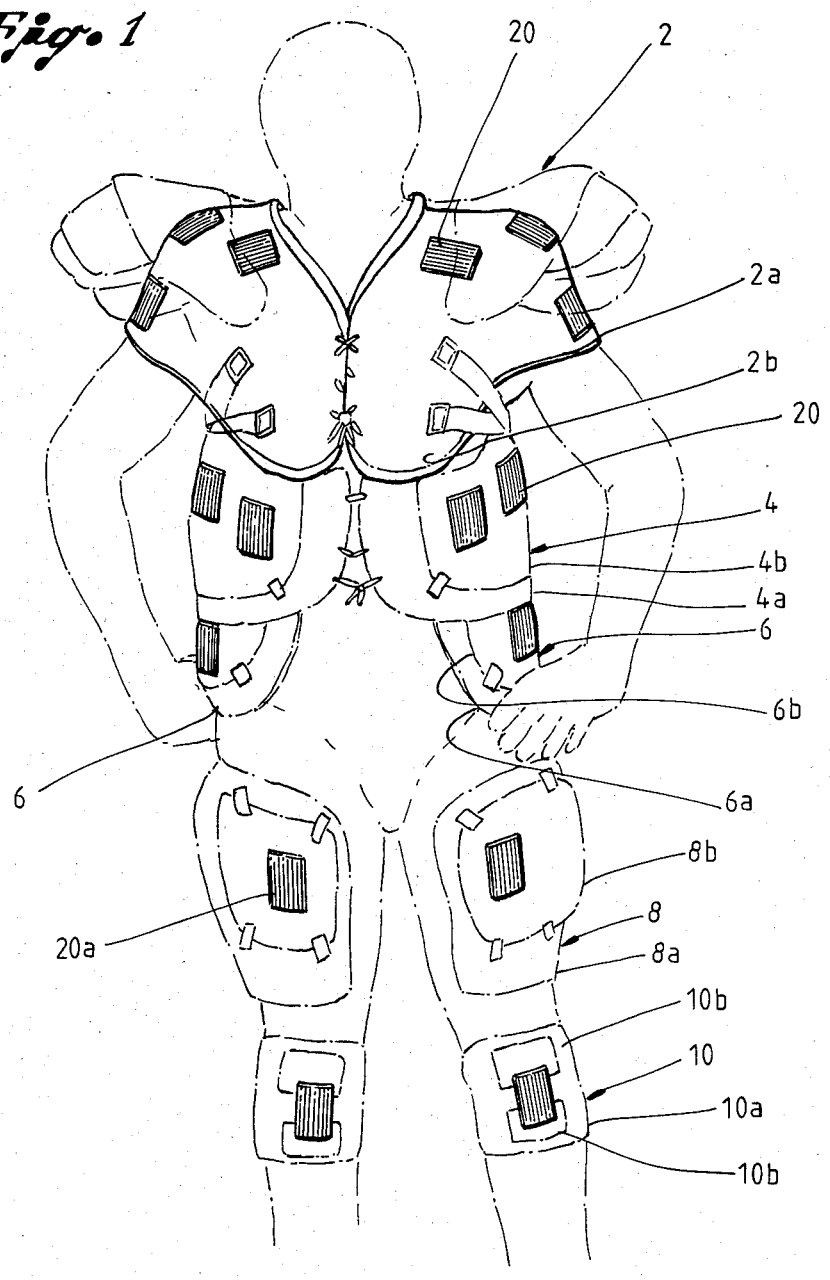
FIG. 1 illustrates a frontal view of a human body clothed in shock absorbing athletic equipment in accordance with the present invention, such equipment having protective inserts at body areas exceptionally prone to injury.
Figure 2:
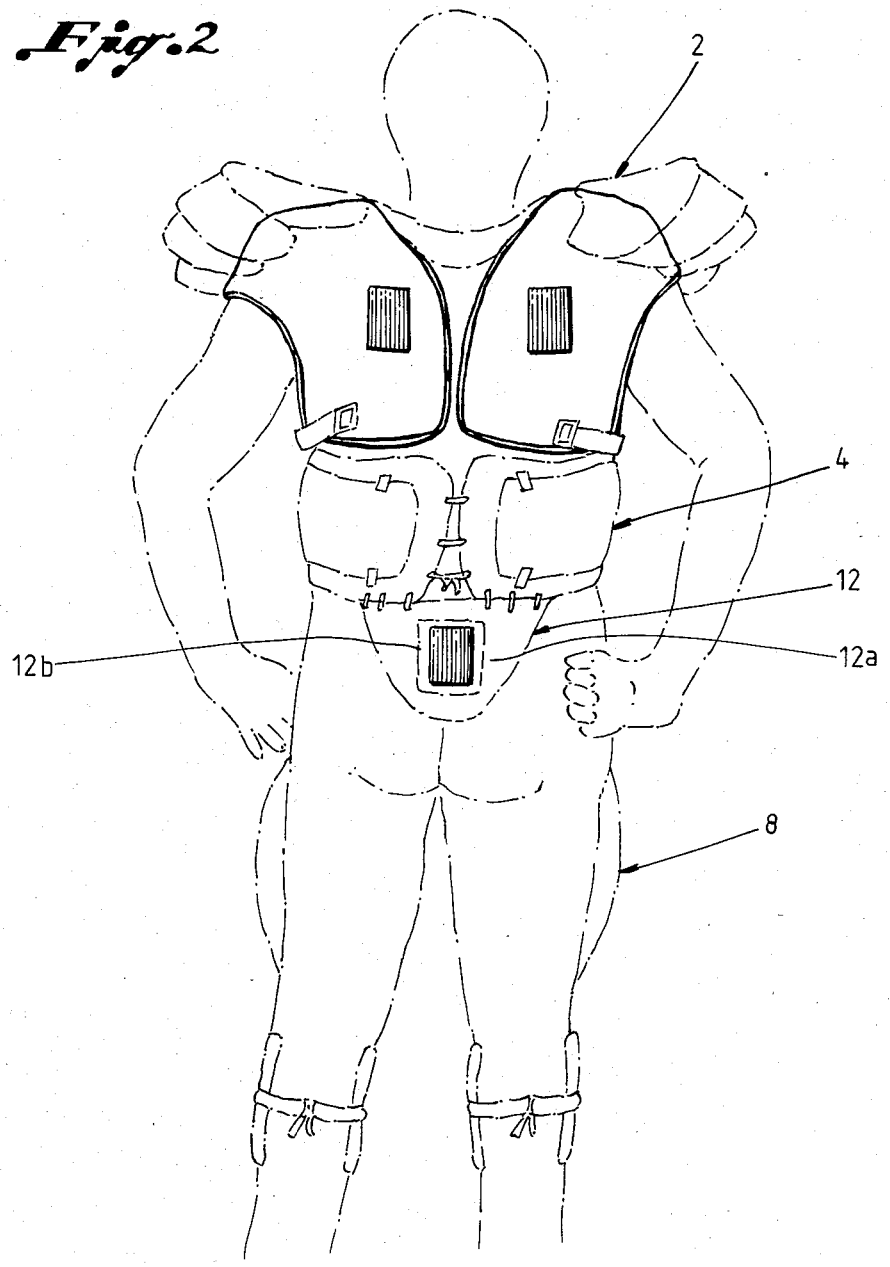
FIG. 2 illustrates a back view of the human body and shock absorbing athletic equipment of FIG. 1.

Referring now to the drawings in more detail, and particularly to FIGS. 1 and 2, therein is illustrated protective athletic equipment having shock absorbing structure in accordance with the present invention, such equipment including shoulder pads 2, a rib protector 4, hip pads 6, thigh pads 8, knee pads 10, and back protector 12. Each piece of equipment has a shock absorbing structure 2*a*, 4*a*, 6*a*, 8*a*, 10*a*, and 12*a*, respectively, disposed against the body of the wearer. In this particularly preferred embodiment, each piece of protective equipment also includes a shield structure 2*b*, 4*b*, 6*b*, 8*b*, 10*b*, and 12*b*, respectively, positioned to distribute an applied force across at least a portion of shock absorbing structures 2*a*, 4*a*, 6*a*, 8*a*, 10*a*, and 12*a*. These shield structures are a desirable feature of the present invention and may be necessary to provide adequate protection to a wearer involved in specific athletic activities or sports. Also, in this particularly preferred embodiment, shield structures 2*b*, 4*b*, 6*b*, 8*b*, 10*b*, and 12*b*, are positioned on the exterior side of shock absorbing structures 2*a*, 4*a*, 6*a*, 8*a*, 10*a*, and 12*a*. Depicted in bold representation are shock absorbing inserts 20 which are positioned with, and preferably form a part of, shock absorbing structures 2*a*, 4*a*, 6*a*, 8*a*, 10*a*, and 12*a*. Shock absorbing inserts 20 are preferably distinct from shock absorbing structures 2*a*, 4*a*, 6*a*, 8*a*, 10*a*, and 12*a*, but are preferably either permanently or removeably attached thereto so as to form a single shock absorbing unit. Inserts 20 are depicted proximate specific body areas which are believed to be especially prone to injury and for which exceptional protection is desirable. The identification of these body areas is illustrative only, and, as will be apparent from the discussion to follow, protective athletic equipment in accordance with the present invention may be adapted to provide exceptional protection to virtually any area of the wearer's body.

Each of the above pieces of protective equipment 2, 4, 6, 8, 10, and 12 include functionally equivalent shock absorbing units in accordance with the present invention, and such shock absorbing units are constructed in essentially the same manner. Therefore, only shoulder pads 2 will be described in detail. The shoulder pads illustrated in FIG. 1 include numerous shield structures and fabric covered foam shock absorbing elements. For sake of clarity, attention will be directed to a pair of shoulder pads having a single shock absorbing portion and a single shield structure in accordance with the present invention. Such a pair of shoulder pads is illustrated in FIG. 3 in perspective view.

Referring now specifically to FIG. 3, it will be seen that shoulder pads 14 include a single shield structure 16 and a shock absorbing structure, illustrated generally at 8. Shock absorbing structure 18 is preferably removably attached to shield structure 16, such as by a hook and loop fastening structure such as that marketed under the name of VELCRO, or may be permanently attached to shield element 16, such as by rivets. Included within shock absorbing structure 18 are a body portion 22 and two inserts 20 which will be discussed in more detail later herein. Body portion 22 preferably represents a significant majority of the composition of shock absorbing structure 18. It is to be clearly understood that, although only one shield element 16 is illustrated and will be discussed herein, it would be common that a plurality of shield elements would be used to compose the shield structure, as illustrated in FIG. 1. Shield element 16 is preferably composed of a semi-rigid plastic or other suitable material, such as the thermo-plastic carbonate polymer sold under the name of LEXAN.

Referring now also to FIG. 4, therein is illustrated a cross-sectional representation of body portion 22 of shock absorbing structure 18, as would be seen along line 4–4 in FIG. 3. Body portion 22 includes a foam core 26 encased within flexible enclosure, preferably a fabric covering, illustrated generally at 28. Fabric covering 28 is preferably a nylon material which is rendered relatively airtight by the inclusion of a polyurethane coating applied thereto. This coating is most preferably applied to the inner surface of fabric 28, that surface contacting foam core 26. Fabric 28 may include a plurality of pieces 25 and 27 joined together to encase foam core 26, as illustrated in FIG. 4, or may be of a single piece contoured and folded to encase foam core 26. Fabric pieces 25 and 27 are bonded along all edges 30 so as to form an essentially airtight enclosure about foam core 26. At least on exterior edges 30 of fabric 28, it is preferred that binding tape 34 be placed about edge 30 and sewn in place. Attachment of tape 34 increases the mechanical strength of edge 30 and enhances the appearance of shock absorbing structure 18. A plurality of apertures 32 are included in fabric pieces 25 and 27, preferably along edge 30. Apertures 32 penetrate through the fabric providing continuous fluid communication between foam core 26, encased within fabric 28, and the atmosphere outside fabric 28.

Inner faces 36 and 38 of fabric pieces 25 and 27 may be bonded to adjacent surfaces of foam core 26 to facilitate the movement of adjacent foam/fabric faces as a unit. This bonding facilitates control over the transfer of air between the cellular structure of foam core 26, inside the enclosure formed by fabric 28, and the atmosphere exterior to such enclosure. When a nylon fabric having a polyurethane coating is used, fabric 28 may be bonded to foam core 26 by adherently applying fabric 28 to foam core 26, such as by heat sealing. When a different type of fabric is used, the fabric may be coated, if desired, and then bonded to foam core 26 in any suitable manner such that the enclosure formed by the fabric is substantially airtight and faces 36 and 38 of foam core 26 are bonded, at least in part, to the internal surfaces of the fabric. As will be apparent to those skilled in the art, any suitable method of bonding pieces of relatively airtight fabric to foam may be employed, such as the use of radio frequency induction heating techniques, the use of adhesive materials, and so forth. Alternatively, pieces of fabric that are not relatively airtight may be bonded to foam core 26 in such a manner that a substantially airtight enclosure is formed. Peripheral edge 40 of foam core 26 may also be bonded to fabric 28 to further enhance the control of the air transfer discussed above.

Foam core 26 is constructed of an open celled material such as, for example, a polyurethane foam. Such foam may be additionally either a reticulated foam, i.e., a foam which has been fire polished to destroy the membranes or thin films joining the strands which divide contiguous cells without destroying strands of the skeletal structure, or which has been chemically treated to destroy such strands. The cellular structure of foam core 26 constitutes a reservoir inside the fabric enclosure which releasably holds air. It will be seen that while foam core 26 may consist of a single layer of such open-celled material, foam core 26 is preferably composed of a plurality of layers. Accordingly, three layers 42*a*, 42*b*, and 42*c* are shown. There may be either a greater or fewer number of these layers as such is shown only for the presentation of a particular preferred embodiment. Where a multi-layer laminate is used, foam layers 42*a*, 42*b*, and 42*c* will have differing foam densities. Foam layer 42*c*, which will be disposed closest to the body of the wearer, will have the lowest foam density. Foam layer 42*c* will preferably have a density of no more than approximately one (1) pound per cubic foot, the preferred range of densities for foam layer 42*c* lying between $\frac{1}{2}$ and $\frac{3}{4}$ pound per cubic foot. This relatively soft foam is used in foam layer 42*c* to enhance comfort levels and provide proper fit. Since the structure must be shaped to conform to the body of the wearer, foam layer 42*c* should have sufficient softness to conform to the contour of the wearer's body while providing good body contact.

Outer foam layer 42*a* has a relatively high foam density. The density range is typically from approximately three (3) pounds per cubic foot to approximately 16 pounds per cubic foot but may be much higher in specific applications. The preferred range in many applications is approximately 3 to 4 pounds per cubic foot.

Foam layer 42*b*, sandwiched between high density outer foam layer 42*a* and low density inner foam layer 42*c* has an intermediate density between the densities of inner and outer foam layers 42*c* and 42*a*, respectively. The preferred density of foam layer 42*b* is typically approximately two (2) pounds per cubic foot.

It is important that foam layer 42*c*, closest to the body, have a low enough density for enhanced comfort and fit, and that the density of outer most layer 42*a* be sufficiently great that the shock absorbing capability of foam core 26 will adequately absorb an inflicted force.

Figure 9:
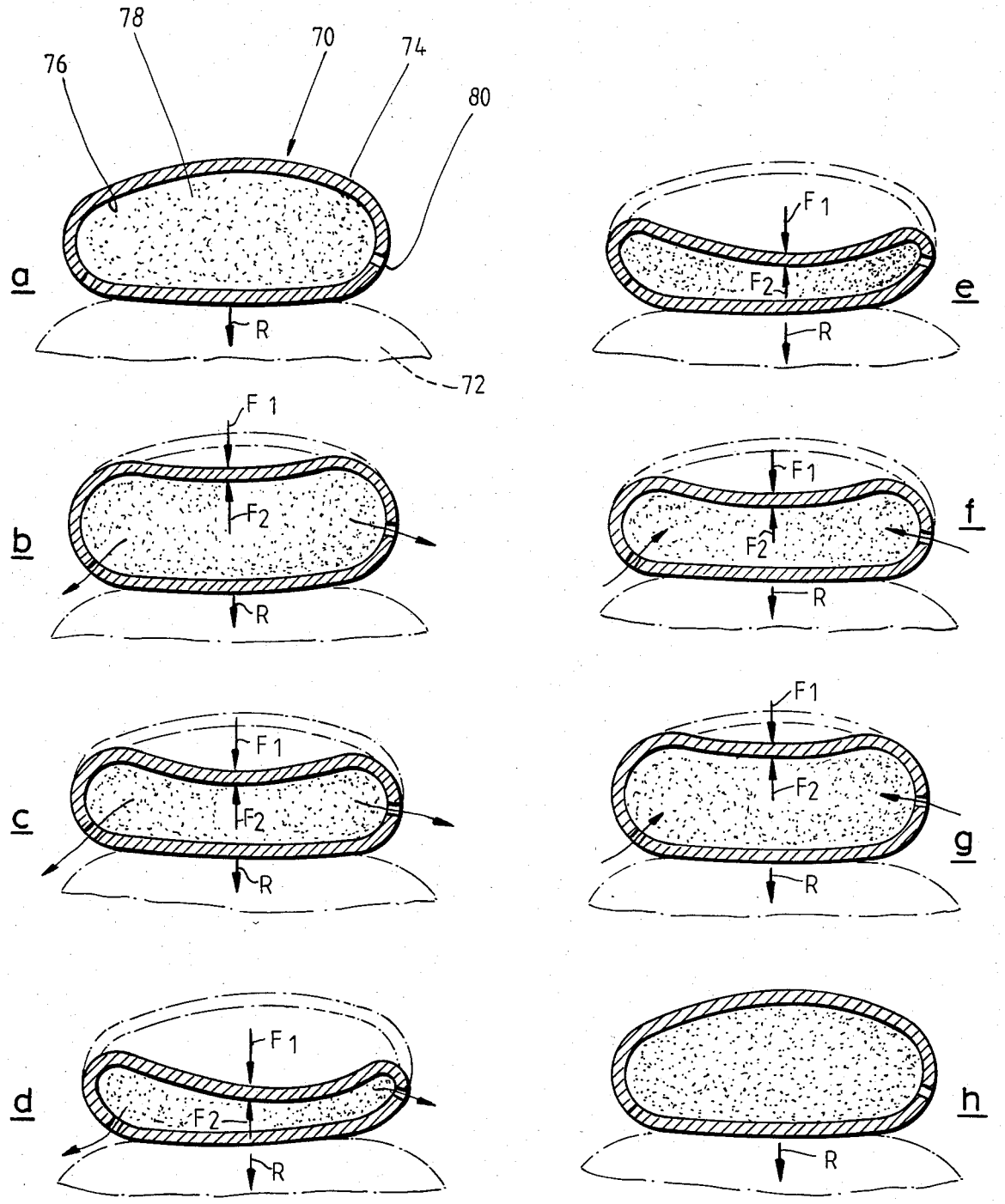
FIGS. 9*a*–9*h* are a schematic illustrations of the effects of a force $F_1$ upon a shock absorbing element in accordance with the present invention.

Referring now to FIG. 9, therein is schematically illustrated a shock absorbing structure 70 constructed in the manner described for body portion 18. Shock absorbing structure 70 is disposed adjacent a wearer 72 and includes an airtight flexible enclosure 74 having a cavity 76. Flexible open-celled foam portion 78 is disposed within cavity 76 such that the outer surface of the foam portion is bonded to the inner surface of the cavity. A plurality of apertures 80 are included in airtight enclosure 74 and provide continuous fluid communication between cavity 76 inside enclosure 74 and the atmosphere outside.

Referring now to FIG. 9*a* in the absence of an external force inflicted upon shock absorbing structure 70, the cells of foam portion 58 in cavity 56 contain a first volume of air at one atmosphere of pressure. The pressure within and without shock absorbing structure 70 is the same because apertures 80 reduce the pressure differential across enclosure 74 to a quiescent value of zero. Because the inflicted external force is zero, the resulted force R transmitted to wearer 72 is also zero.

Referring now to FIG. 9*b*, a force $F_1$ of a given magnitude is inflicted upon shock absorbing structure 70. As the force $F_1$ is inflicted upon the shock absorbing structure 70, a portion of the air contained in the cellular structure of foam portion 78 is transferred from cavity 76, through apertures 80, and into the atmosphere outside structure 70. The volume of air transferred per unit of time, which is determined by the size and number of apertures 80, is chosen to create a back pressure in cavity 76 which presents the inflicted force $F_1$ with a force $F_2$ of equal magnitude and opposite direction. The forces $F_1$ and $F_2$ vectorially add such that the resultant force R imparted to the wearer 52 is essentially zero.

In the absence of apertures 80, the inflicted force may tend to distort the shape of cavity 76, but it cannot alter the volume of air contained within cavity 76 because air is essentially an incompressible fluid. On the other hand, if apertures 80 were uncontrollably large, the inflicted force $F_1$ would tend to collapse structure 70 expelling the air contained within the cellular structure of foam portion 78 through aperture 80. In either case, a significant portion of the inflicted force would likely be imparted to the wearer. Controlled expulsion of the air contained in the cellular structure, however, reduces the resultant force imparted to the wearer to substantially zero.

The force $F_1$ exists for some finite period of time and thus can be viewed as increasing in magnitude from zero to some maximum value, dwelling at that maximum value for some finite period of time, and then decreasing from that maximum value to zero. FIGS. 9*b*, 9*c* and 9*d* schematically illustrate the behavior of shock absorbing structure 70 as the inflicted force increases to its maximum value.

As the magnitude of the force increases, the pressure within cavity 76 increases to a value above one atmosphere and air within the cellular structure of foam portion 78 is expelled through apertures 80. Both the air pressure in the cavity and the volume of the cavity decrease.

As the force $F_1$ reaches its maximum value, the rate of change of $F_1$ per unit of time reaches zero. Therefore, the rate of change of cavity volume per unit of time and the volume of air expelled from the cavity per unit of time also reach zero. This is depicted in FIG. 9*e*.

The inflicted force $F_1$ then decreases in magnitude from the maximum value to zero, and the elasticity of foam portion 78 causes cavity 76 to increase in volume. As the volume increases, air is drawn through apertures 80 and into cavity 76 from the atmosphere outside shock absorbing structure 70. This is schematically illustrated in FIG. 9*f* and 9*g*. The rate at which air is drawn into cavity 76 and thus the rate at which the volume of the cavity increases, is again determined by the number and size of the apertures 80 and is chosen such that the forces $F_1$ and $F_2$ add vectorially to produce a resultant force R of substantially zero magnitude.

After the magnitude of the inflicted force $F_1$ has decreased to zero, cavity 76 returns to its initial volume as illustrated in FIG. 9*h*, which depicts a condition identical to that of FIG. 9*a*. In this quiescent condition, the pressure within and without cavity 76 is at one atmosphere. Protective equipment having a shock absorbing element 22 constructed in its entirety in accordance with the foregoing description of body portion 18 has been found to serve excellently to provide protection to a wearer. However, it may further be desirable to provide added protection to the wearer in selected areas. For example, when the wearer has sustained an injury to a particular portion of his body, it is desirable that such portion be optimally protected to avoid further injury and/or pain to the wearer. Additionally, it will often be preferable to provide exceptional protection to "critical points" of the wearer's body, i.e., areas which are naturally especially prone to injury. Although the significance of individual critical points may vary in response to various activities, specific critical points have been found to include such areas as the acronim of scapula, the protrusion between ribs 7–10, and the knees, etc.

It is optimal to provide a shock absorbing element adjacent such critical areas which will not "bottom out", thereby losing its shock absorbing properties. While it would be optimal to provide such a non-bottoming element for any protected area of the wearer's body, a practical limitation upon the overall shock absorbing element is that the element be of comfort to the wearer and place minimal restrictions upon his freedom and speed of movement. In many locations proximate the body, an element which provided a significant enough resistance to force so as to provide these optimal shock absorbing capabilities would tend to provide similar resistance to movement of the wearer's body against the element thereby both restricting his movement and adversly affecting his comfort. Further, areas of the body which are not overly susceptible to injury do not require such exceptional protection so such restriction for the benefit of selected areas would be needless. Accordingly, insert pads 20 are introduced at selected areas within shock absorbing structure 18 so as to contact and protect desired areas of the wearer's body. In general, it is believed that most naturally-occurring injury prone critical points represent a roughly six to eight square inch area. Accordingly, a preferred embodiment of insert to protect these critical points is approximately three inches by four inches, providing twelve square inches of surface protection. However, it is to be understood that these dimensions are exemplary of a preferred embodiment only and may be adapted to suit differing dimensions. Further, it is a particular feature of the present invention that the inserts may be freely adapted in size, shape, contour, and number to provide optimal protection specifically tailored to the needs and characteristics of an individual's body.

As stated above, a distinct feature of inserts 20 is that they will not lose shock absorbing qualities under the forces to which they are expected to be subjected. Within such design constraints, several embodiments of insert pads may be suitable.

Figure 5:
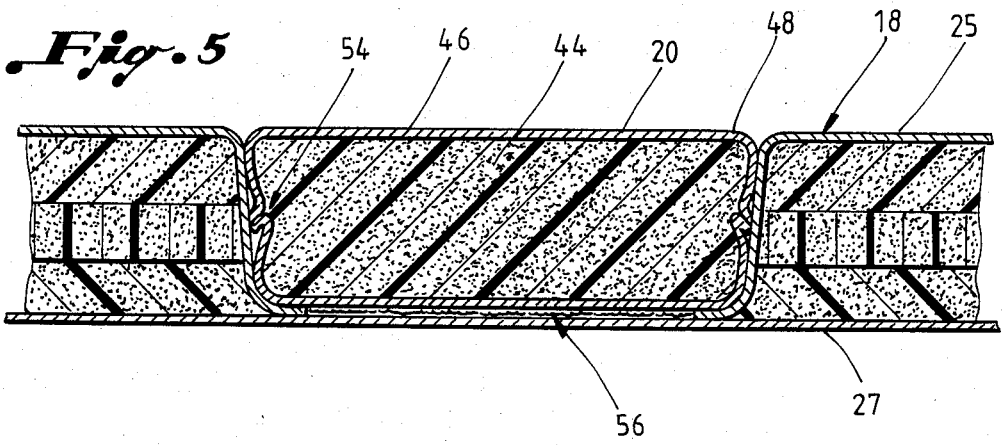
FIG. 5 illustrates a cross-sectional view of a shock absorbing element in accordance with the present invention as might be viewed along line 5—5 in FIG. 3.

Referring now to FIG. 5, therein is illustrated a particularly preferred embodiment of insert pad 20 secured to body portion 22. Insert pad 20 includes a foam core 44 encased within a flexible, preferably fabric enclosure 46. As with body portion 22 of shock absorbing structure 18, insert foam core 44 is preferably of an open-celled foam material. However, insert foam core 44 may be of a closed cell foam material as will be discussed further later herein. Fabric enclosure 46 is again preferably of nylon fabric rendered relatively impervious to air by a polyurethane coating applied thereto. As with body portion 22, edges 50 of fabric enclosure 46 are sealed such that fabric enclosure 46 is generally impermeable to air. The shock absorbing characteristics of insert 20 may be achieved by a variety of mechanisms, such as apertures 48 or valves (not illustrated) in fabric enclosure 46, whereby the transfer of air between insert form core 44 will provide shock absorbtion in a manner similar to that utilized in body portion 22. It will be appreciated that if air transfer is controlled through apertures, insert 20 will typically contain fewer and/or smaller apertures than would a comparable area of body portion 22. Alternatively, an insert foam core 44 of higher foam density than that of foam core 26 of body portion 18 may be utilized, potentially in conjunction with apertures similar in size and/or number to those found within body portion, to achieve the desired shock absorbing capability.

Viewing FIG. 5, it will be seen that aperture 52 in foam core 26 of body portion 18 is fully enclosed by fabric pieces 25 and 27, thereby forming a recess 54 in which insert 20 is placed. Insert 20 may be attached to body portion and may be removably attached thereto, such as by a hook and loop type fastening mechanism 56 such as that marketed under the name VELCRO. Alternatively, insert 20 may be permanently attached to body portion 18 such as by being sewn in place.

As mentioned earlier herein, insert foam core 44 may be at least partially composed of a closed-cell foam material. Such a closed-cell foam core does not serve as an exhaustable air reservoir as does the open-celled foam core discussed above. Rather, a closed cell foam will respond essentially as a compressable, resilient pad. The transfer of air between foam core 44 and the atmosphere is not applicable with a closed cell foam core. Therefore, where foam core 44 is entirely of closed cell foam material, there is typically no necessity for apertures or valves providing fluid communication through fabric covering 46.

Figure 6:
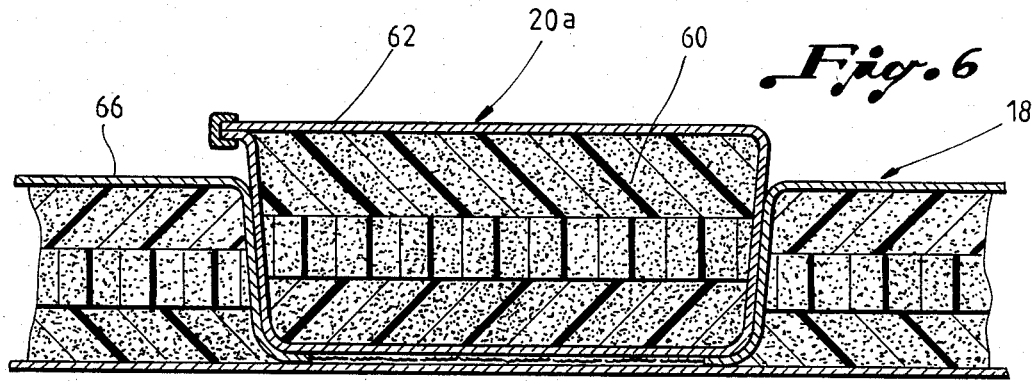
FIG. 6 illustrates an alternative embodiment of a shock absorbing element in accordance with the present invention, also as might be seen along line 5—5 in FIG. 3.

Referring now to FIG. 6, therein is shown an insert **20*a*, wherein foam core 60 is a multi-layered foam laminate. As with body portion 22, the individual layers of foam core 60 will typically be of different foam densities in accordance with desired shock absorbing characteristics. It will be appreciated that, in a manner similar to the previous embodiment, one or more layers of foam core 60 may be of closed cell foam material. Enclosure 62 of insert 20*a* is formed of a single piece of fabric formed around foam core 60** in an alternative construction technique.

In an alternative configuration, insert **20*a* is depicted as extending beyond surface 66 of body portion 18, surface 66 being that surface of body portion 18 which will lie closest to the wearer's body. This protruding configuration of insert 20*a* may have particular applicability in cases in which the wearer has unusual body contours which might not be contacted by an insert 20*a* which was flush with surface 66 of body portion 18**. Such unusual body contours may be either naturally occurring or may be the result of surgery to the wearer.

Referring now to FIG. 7, therein is illustrated another alternative embodiment in which insert **20*b* may be an inflatable/deflatable envelope having a self-sealing inflating valve 68. The envelope can be inflated to a desired pressure in response to the protection needed by the garment wearer and the forces to which insert 20*b*** is likely to be subjected. It will be appreciated that the ability of the envelope to absorb shock will be a function not only of the air pressure within the envelope, but also of the elasticity of the material forming the envelope.

Similarly, in another alternative embodiment utilizing features of the embodiments discussed above, insert 20 may include an enclosed foam core such as that discussed with respect to FIGS. 5 and 6, with the exception that, instead of providing the enclosure with apertures, valves may be incorporated whereby insert 20 may be inflated to a desired pressure. The foam core within the enclosure facilitates the forming of insert 20 into a desired shape which is not facilitated when using a purely inflatable envelope as discussed with reference to FIG. 7. It is preferable that the foam core be bonded to the inner surface of the envelope, as discussed earlier herein, to facilitate the desired shaping. In such an embodiment, it is highly preferable that the foam core be composed of open-celled material since such facilitates the pressurization of the volume of air retained within the foam core. It will be appreciated that such an embodiment will appear essentially the same as inserts 20 and 20A in FIGS. 5 and 6, respectively, with the exception that the enclosure of such an insert would not have an aperture as illustrated in FIG. 5 and would have a valve such as self sealing inflating valve 68 as illustrated in FIG. 7.

Figure 8:
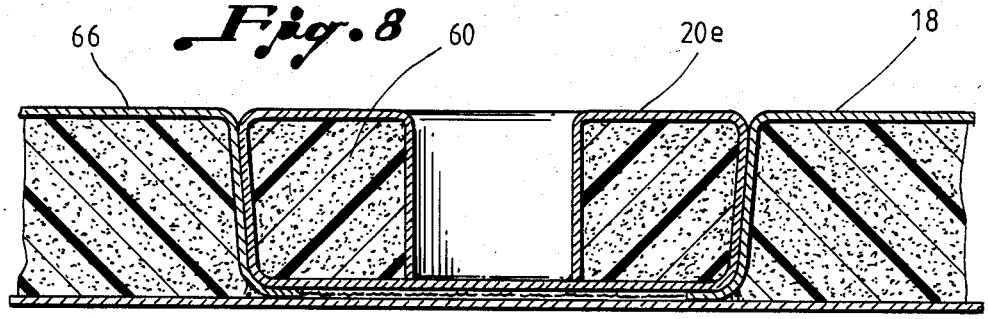
FIG. 8 illustrates a cross-sectional view of another alternative embodiment of a shock absorbing element in accordance with the present invention, also as might be seen along line 5—5 in FIG. 3.

Finally, it should be noted that, rather than being a separately constructed insert piece, insert 20 may be eliminated entirely and a void left in its place as shown in FIG. 1 at **20*d*, or it may be constructed with a void area in its center, as depicted as insert 20*c* in cross-section in FIG. 8**. The effect of such a construction, when utilized in combination with an appropriate surrounding shock absorbing and cushioning structure and shield structure, will be to create a "donut" of protection which can then function to protect already injured, bruised or inflamed areas of the body without creating undue pressure against the existing sore spot.

Shock absorbing athletic equipment in accordance with the present invention anticipates that different types of inserts and/or voids, such as those described above, may be situated adjacent various areas of a wearer's body. These inserts and/or voids may be of varied construction and shock absorbing capabilities as well as in any combination in response to considerations such as the protection desired at specific locations of the wearer's body and the comfort of the wearer.

Many modifications and variations may be made in the methods and apparatus described herein and depicted in the accompanying drawings without departing substantially from the concept of the present invention. For example, the shock absorbing inserts may be attached to the inner surface of the body portion adjacent at least a portion of the foam core therein or may be secured within a smaller recess in the body portion such that an impacting force will encounter both the body portion foam core and the insert. Further, inserts which include both an inflatable element and a foam element separate and distinct from the inflatable element may be utilized. Further, the inserts may be formed so as to be an integral portion of the shock absorbing structure, such as being encased within a single flexible covering with the body portion. It should also be understood that my application of the "critical point" theory is not applicable only to the preferred construction of my protective equipment. One embodiment employing the CP concept would be a protective piece which was constructed primarily of closed-cell foamed plastic construction with open cell foam construction only at the critical points. Accordingly, the embodiments presented in the foregoing specification are illustrative of particular preferred embodiments only, and are not intended as limitations on the scope of the present invention.

The embodiments of the invention in which an exclusive property or privilege are claimed are defined as follows:

1. Shock absorbing athletic equipment for protecting a wearer from externally impacting forces, comprising:

a shock absorbing body portion designed to generally cover and protect at least a portion of a wearer's body, comprising, a flexible enclosure defining an internal cavity therein, said flexible enclosure being generally impermeable to air, means for placing said cavity within said enclosure in limited fluid communication with the exterior of said enclosure, and a foam core retained within said cavity, said foam core formed of an open-celled material; and a shock absorbing insert portion secured to said body portion and situated to contact a selected area of the body of said wearer, said insert having shock absorbing capability distinct from that of said shock absorbing body portion, said insert adapted to maintain said shock absorbing capability when impacted by a force of an anticipated magnitude.

2. The shock absorbing athletic equipment of claim 1, wherein said body portion flexible enclosure comprises nylon fabric.

3. The shock absorbing athletic equipment of claim 2, wherein said nylon fabric is rendered generally impermeable to air by a coating of polyurethane on at least a first surface of said fabric.

4. The shock absorbing athletic equipment of claim 1, wherein said means for placing said cavity within said enclosure in limited fluid communication with the exterior of said enclosure comprises at least one aperture through said enclosure.

5. The shock absorbing athletic equipment of claim 1, wherein said means for placing said cavity within said enclosure in limited communication with the exterior of said enclosure comprises at least one valve allowing the exit of air from said cavity and wherein said body portion further comprises at least one valve allowing the inlet of air to said cavity from said exterior of said enclosure.

6. The shock absorbing athletic equipment of claim 1, wherein said body portion foam core comprises a multilayered laminate of open-celled foam material.

7. The shock absorbing athletic equipment of claim 1, wherein a surface of said foam core is at least partially bonded to an adjacent internal surface of said enclosure.

8. The shock absorbing athletic equipment of claim 1, wherein said insert comprises a flexible enclosure defining an internal cavity said flexible enclosure being at least generally impermeable to air.

9. The shock absorbing athletic equipment of claim 8, wherein said insert further comprises a foam core contained within said insert cavity.

10. The apparatus of claim 9, wherein said insert foam core is formed of open-celled foam material.

11. The shock absorbing athletic equipment of claim 9, further comprising means for placing said cavity in limited fluid communication with the exterior of said insert enclosure.

12. The shock absorbing athletic equipment of claim 9, wherein said insert foam core is formed of closed-cell foam material.

13. The shock absorbing athletic equipment of claim 8, wherein said insert further comprises means for inflating said enclosure to a pressure greater than one atmosphere.

14. The shock absorbing athletic equipment of claim 1, further comprising a shield structure adapted to distribute said impacting force over at least a portion of said shock absorbing body portion.

15. The shock absorbing athletic equipment of claim 14, wherein said first and second surfaces of said body portion foam core are at least partially bonded to adjacent surfaces of said fabric enclosure around said foam core.

16. Shock absorbing athletic equipment for protecting a wearer's body from an externally impacting force, comprising:

a shock absorbing body portion adapted to generally conform to said wearer's body and to generally make contact therewith except at at least one selected area, said body portion comprising, a foam core having first and second major surfaces, said foam core comprising a multi-layered laminate of open-celled foam material, said foam core having an aperture therethrough between said first and second major surfaces, said aperture situated to lie proximate said selected area of said wearer's body when said protective equipment is upon said wearer's body, an enclosure around said foam core, said enclosure formed of a fabric rendered relatively impermeable to air such that a relatively air-tight enclosure is formed around said foam core, said enclosure shaped to follow the contour of said foam core on at least one side of said body portion, and means for providing fluid communication between the interior of said enclosure and the exterior of said enclosure;

a shock absorbing insert adapted to fit within the area defined by said contour of said enclosure around said aperture in said foam core, said insert adapted to withstand an impacting force of a given force magnitude without said insert losing its shock absorbing capability; and a shield structure adapted to distribute said impacting force over at least a portion of said body portion.

17. The shock absorbing athletic equipment of claim 16, wherein said fabric forming said enclosure is nylon.

18. The shock absorbing athletic equipment of claim 17, wherein said nylon fabric is rendered relatively impermeable to air by a polyurethane coating on a surface of said fabric which is to the interior of said enclosure.

19. The shock absorbing athletic equipment of claim 16, wherein said means for placing said interior of said enclosure in fluid communication with said exterior of said enclosure comprises at least one aperture through said fabric enclosure.

20. The shock absorbing athletic equipment of claim 16, wherein said means for placing said interior of said enclosure in fluid communication with said exterior of said enclosure comprises at least one valve allowing the exit of air from said enclosure and wherein said body portion further comprises at least one valve allowing the passage of air to the interior of said enclosure from exterior of said enclosure.

21. The shock absorbing athletic equipment of claim 16, wherein said insert comprises a flexible pad having a given shock absorbing capability.

22. The shock absorbing athletic equipment of claim 16, wherein said insert comprises:

a flexible enclosure defining an internal cavity, said flexible enclosure constructed of a material at least generally impermeable to air; and a foam core within said cavity in said enclosure.

23. The shock absorbing athletic equipment of claim 22, wherein said insert further comprises means for providing limited air transfer between said cavity in said enclosure and the atmosphere exterior to said enclosure and wherein said foam core constructed at least partially of an open-celled foam material.

24. The shock absorbing athletic equipment of claim 16, wherein said insert further comprises a foam core contained within said cavity in said enclosure and wherein said enclosure is inflatable to a pressure greater than one atmosphere.

25. The shock absorbing athletic equipment of claim 15, wherein said insert comprises an inflatable/deflatable member.

26. The shock absorbing athletic equipment of claim 25, wherein said means for attaching said insert to said body protion comprises a hook and loop fastening mechanism cooperatively arranged between said insert and said body protion.

27. The shock absorbing athletic equipment of claim 26, wherein said insert is permanently attached to said body portion.

28. The shock absorbing athletic equipment of claim 16, further comprising means for attaching said insert to said body portion.

* * * * *

UNITED STATES PATENT AND TRADEMARK OFFICE

CERTIFICATE OF CORRECTION

PATENT NO. : 4,513,449

DATED : April 30, 1985

INVENTOR(S) : Byron A. Donzis

It is certified that error appears in the above-identified patent and that said Letters Patent is hereby corrected as shown below:

Claim 25, line 2, "15" should read --16--.

Signed and Sealed this

*Thirteenth* Day of *August 1985*

[SEAL]

*Attest:*

DONALD J. QUIGG

*Attesting Officer*

*Acting Commissioner of Patents and Trademarks*